US007104010B2

(12) United States Patent
Winner

(10) Patent No.: US 7,104,010 B2
(45) Date of Patent: Sep. 12, 2006

(54) HERMETIC JALOUSIE WINDOW HARDWARE

(75) Inventor: Kurt Winner, Waipahu, HI (US)

(73) Assignee: Costal Windows Inc., Waipahu, HI (US)

( * ) Notice: Subject to any disclaimer, the term of this patent is extended or adjusted under 35 U.S.C. 154(b) by 252 days.

(21) Appl. No.: 10/804,341

(22) Filed: Mar. 19, 2004

(65) Prior Publication Data

US 2005/0204633 A1 Sep. 22, 2005

(51) Int. Cl.
*E06B 7/08* (2006.01)

(52) U.S. Cl. ..... 49/403; 49/74.1

(58) Field of Classification Search ..... 49/403, 49/74.1, 89.1, 371, 82; 52/72, 200, 473
See application file for complete search history.

(56) References Cited

U.S. PATENT DOCUMENTS 2,760,242 A * 8/1956 Armstrong ..... 49/403
2,902,731 A * 9/1959 Sconzo ..... 49/403
2,952,051 A * 9/1960 Scott ..... 49/403
3,205,541 A * 9/1965 Beards ..... 49/371
3,375,608 A * 4/1968 Thompson ..... 49/403
4,187,641 A * 2/1980 Thompson ..... 49/403
4,268,995 A * 5/1981 Villa ..... 49/87.1
4,505,079 A 3/1985 Black
4,570,394 A * 2/1986 Jentoft et al. ..... 52/72
4,630,399 A * 12/1986 Okumoto ..... 49/403
4,899,491 A 2/1990 Okumoto
5,560,147 A * 10/1996 Ashida et al. ..... 49/74.1
5,794,380 A * 8/1998 Guardia ..... 49/74.1
5,907,926 A 6/1999 Sosa
6,098,339 A 8/2000 Rivera
6,098,340 A * 8/2000 Francis ..... 49/74.1

* cited by examiner

*Primary Examiner*—Hugh B. Thompson, II
(74) *Attorney, Agent, or Firm*—Ostrolenk, Faber, Gerb & Soffen, LLP

(57) ABSTRACT

A glass holder for a jalousie window, including a body having two parallel side walls which define a slot, and two webs which extend substantially perpendicularly in opposite directions from a base of the slot walls. The body has a length and the webs each extend from a respective end of the body over a respective portion of the length of the body. Each web has an outer edge with a baffle that extends in a direction parallel the slot walls.

10 Claims, 4 Drawing Sheets

HERMETIC JALOUSIE WINDOW HARDWARE

BACKGROUND OF THE INVENTION

The present invention relates to jalousie windows, and more specifically to jalousie hardware.

Conventional jalousie window hardware consists of molded plastic glass holders, rotationally engaged to an aluminum channel extrusion. A pair of extrusions are attached to opposing sides of a window frame.

Each of the extrusion members is provided with a series of holes that are rotational mounting locations for each glass holder.

Jalousie window hardware was traditionally manufactured entirely from stamped metal components consisting mainly of aluminum and some steel parts. The principal of operation was similar to that used today, however the functioning push rods and all pivot pins were fully exposed thereby creating an unattractive appearance and thus resulting in premature failure due to weather exposure and physical damage.

In recent decades, the operating mechanism has been enclosed in an aluminum channel and the metal glass holders are produced by an injection molded plastic. The mechanism enclosure now protects the operating components and the glass holders are immune to corrosion which was previously a serious problem with metal glass holders.

Since the glass holders must be free to rotate, they require adequate clearance to do so. This clearance allows direct light, water and wind to pass between the glass holder and the aluminum extrusion.

SUMMARY OF THE INVENTION

Accordingly, it is an object of the present invention to provide jalousie hardware and a glass holder which ameliorate the problems associated with the prior art regarding entry of direct light, air and water between the glass holder and the aluminum extrusion.

Pursuant to this object, and others which will become apparent hereafter, one aspect of the present invention resides in jalousie window hardware which includes an aluminum channel and plastic glass holders rotatably mounted to the channel. Each of the glass holders has a longitudinal slot into which a glass slat is inserted. Inside the channel are two push rods to which the glass holders are attached. An operating handle is also connected to the push rods and serves to actuate them whereby the glass holders are caused to rotate. This operation is known. A window is typically constructed using a pair of jalousie hardware assemblies which are arranged opposite one another. Only one of the assemblies has an operating handle, with the other side being a slave side. Rotational torque is transmitted from the actuator assembly to the slave assembly through the glass slats themselves.

The glass holders are provided with baffles which extend from the glass holder in a direction opposite the slot and parallel to the slot walls. One baffle is provided at each longitudinal edge of the glass holder. When the glass holder is mounted to the aluminum channel, the baffles extend beyond the top surface of the channel in which the glass holder is mounted. In this way, when the glass holder is rotated into a closed position, the baffles rest substantially against the lateral side walls of the channel in a corner region between the side walls and the top surface of the channel.

The baffle acts to block light, wind and water penetration between the upper surface of the channel and the glass holder.

Another object of the invention is to provide a glass holder which securely holds the glass slat in place while still allowing the slat to be removed for maintenance and repair. To accomplish this, the present invention uses a rigid plastic glass holder that can be temporarily deformed by the glass slat as it is forced into the holding slot. Once the glass is in place, the holder snaps into its original shape and thereby captures the glass slat therein. The holding strength of the glass holder is such that finger pressure is insufficient to deform the glass holder enough to remove the glass slat. A special tool is required to deform the glass holder to an extent sufficient to permit glass removal. This need for a special tool to remove the glass slats provides added security against break-ins. In prior jalousie windows, break-ins and forced entry were easily accomplished by removing the slats using finger pressure alone. The present invention overcomes this problem.

The invention overcomes the shortcomings of the prior art by providing a simple construction which greatly reduces light, air and water entry through the clearance areas between the glass holder and the contact surface of the aluminum channel. Proper operating tolerances are maintained, while light, air and water penetration are greatly reduced.

For a more complete understanding of the jalousie window of the present invention, reference is made to the following detailed description and accompanying drawings in which the presently preferred embodiments of the invention are illustrated by way of example. That the invention may be embodied in several forms without departing from the spirit or essential characteristics thereof, it is expressly understood that the drawings are for purposes of illustration and description only, and are not intended as a definition of the limits of the invention. Throughout the following description and drawings, identical reference numbers refer to the same component throughout the several views.

DETAILED DESCRIPTION OF THE INVENTION

Figure 1:
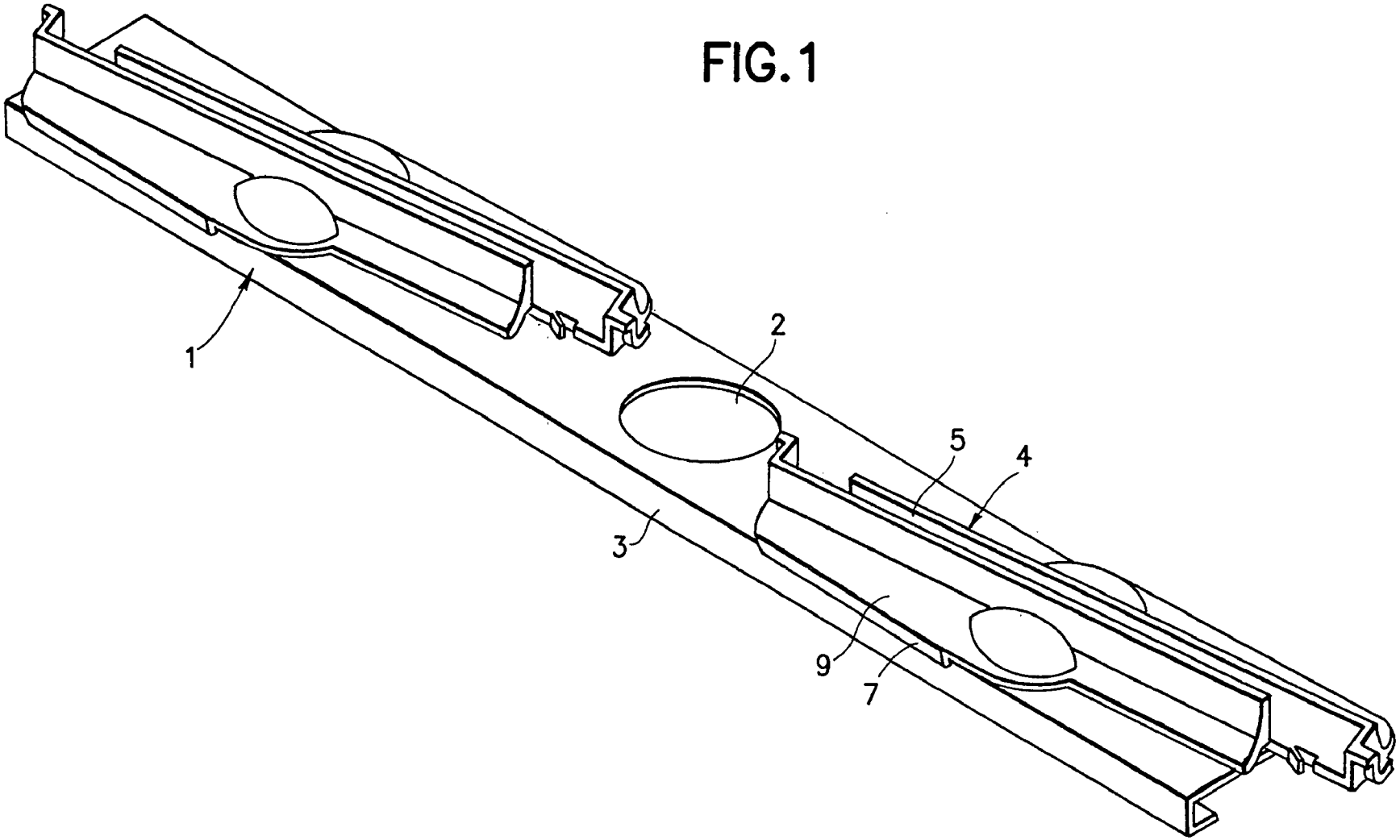
FIG. 1 is a perspective view of jalousie window hardware pursuant to the present invention.
Figure 2:
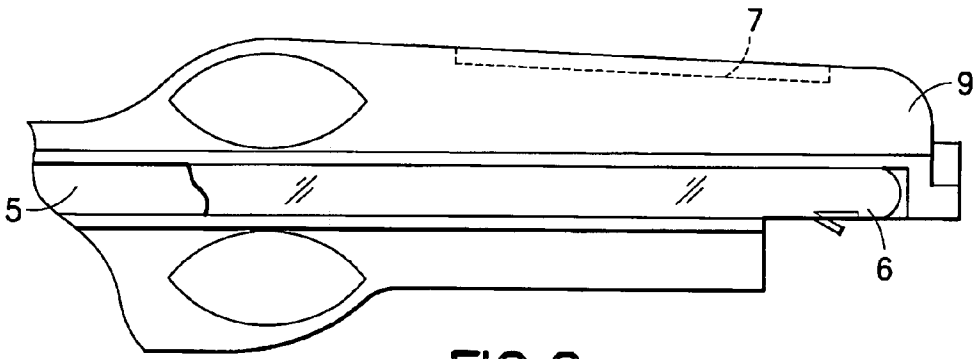
FIG. 2 is a top view of a portion of the glass holder pursuant to the present invention.
Figure 4:
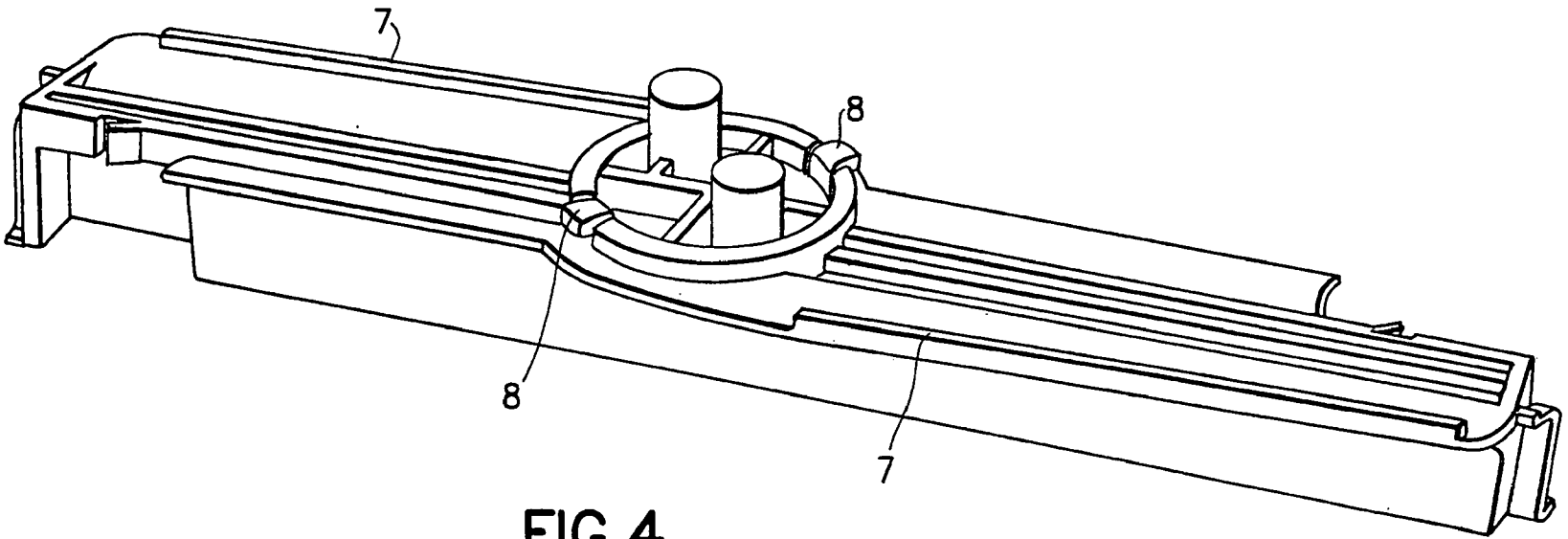
FIG. 4 is a perspective view of the bottom of the glass holder.

FIG. 1 shows an aluminum extrusion 1 which forms one side of the jalousie window. The extrusion 1 is a channel that has holes 2 in an upper surface thereof. The channel also has two lateral side surfaces 3 that form a corner with the upper surface. An injection molded plastic glass holder 4 is rotatably mounted in the hole 2 of the channel 1. As seen in FIG. 4, the glass holder 4 fits in the hole with a conventional snap fit 8. Such a snap fit is known in the art and thus will not be discussed further here. Once the glass holder is engaged in the hole in the channel it is free to pivot.

The glass holder 4 has a slot 5 in which a glass slat is held with a tight slip fit. It is understood that the slats can be made of materials other than glass as well. The other end of the glass slat is also mounted in a slot of a further glass holder. This further glass holder is rotatably held in a further aluminum channel. The two channels are parallel to one another and form the sides of the jalousie window. One of the channels has an operating mechanism which pivots the glass holder at one end of the slat. The glass holder at the other end of the slat is not connected to any operating mechanism. The rotational torque for rotating this glass holder is transmitted through the slat itself and then the actuating glass holder.

The glass holder in cross-section has an inverted T-shape. The central leg of the T is made of two walls that form the slot 5. The arms or webs of the T extend from the central leg substantially perpendicularly toward the corner of the channel at which the side walls 3 meet the top surface. The arms 9 only extend to the corner for substantially half the length of the glass holder 4 from opposite ends of the glass holder and on opposite sides of the glass holder. Thereby, when viewing the glass holder 4 looking in the direction into the slot 5, the arm extending to the corner of the channel on one side of the slot extends along a length of the glass holder that the arm extending to the corner of the channel on the opposite side of the slot does not cover. Each of the arms has a baffle 7 that extends from the end of the respective arm in a direction opposite the walls of the slot. When the glass holder 4 is in a closed position as shown in FIG. 1, the baffles 7 engage the side walls 3 of the channel. The baffles 7 form a barrier which prevents air, light and water from entering between the upper surface of the channel and the bottom of the glass holder. Since each baffle covers its own respective portion of the overall length of the glass holder, the result is a barrier being formed against air, light and rain over substantially the entire length of the glass holder.

In an open position of the jalousie window, the glass holder pivots so that the baffles separate from the side walls of the channel.

Figure 5:
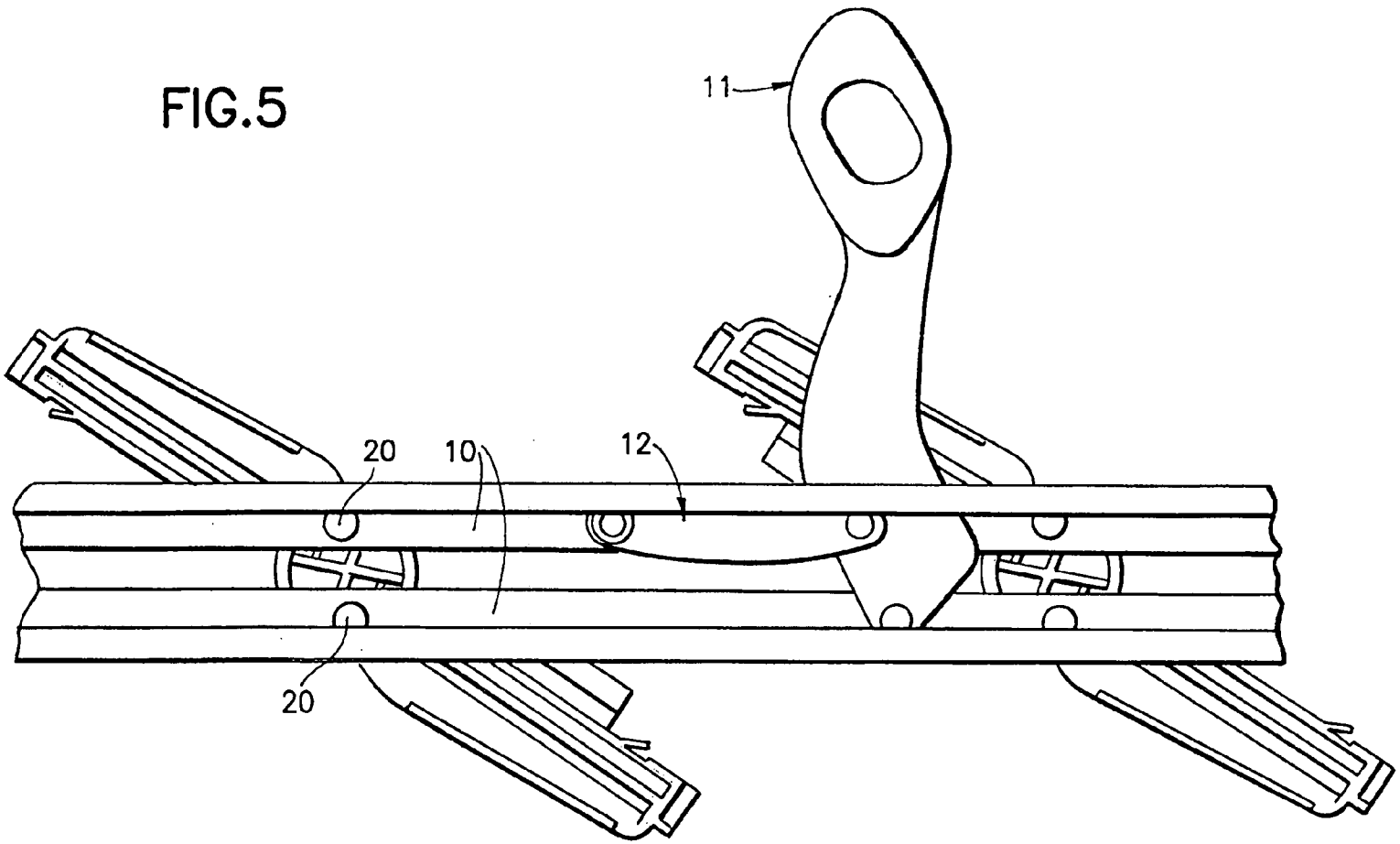
FIG. 5 is a back view of the jalousie hardware.

FIG. 5 is a view of the back side of the channel on the operating side of the window. As can be seen here, two push rods 10 are slidably arranged within the channel. The push rods have holes therein which accept pins 20 provided at the back end of the glass holder 4. In this way, when the glass holder is mounted in the hole 2 at the upper surface of the channel and the pins penetrate through the holes in the push rods 10, imparting an opposite and parallel movement to the respective push rods causes the glass holder to rotate and thus either open or close the glass slat. Since the pins at the rear of the glass holder are plastic and they engage in the metal push rods 10, there is no metal-to-metal contact at the pivot point of the glass holder. This prevents the build up of galvanic corrosion which over time would lead to a negative effect on the operation of the window.

The push rods are moved by an actuating lever 11 that is directly connected to one of the push rods 10 and is connected to the other push rod 10 by a link 12. This construction and operation of the actuator arm 11 and the push rods 10 is known to those skilled in the art and will not be discussed in greater detail here.

The present invention, due to the baffle 7, blocks substantially the entire contact edge between the channel and the glass holder and thereby improves tremendously on the sealing out of air, light and water as compared with the prior art.

Figure 3:
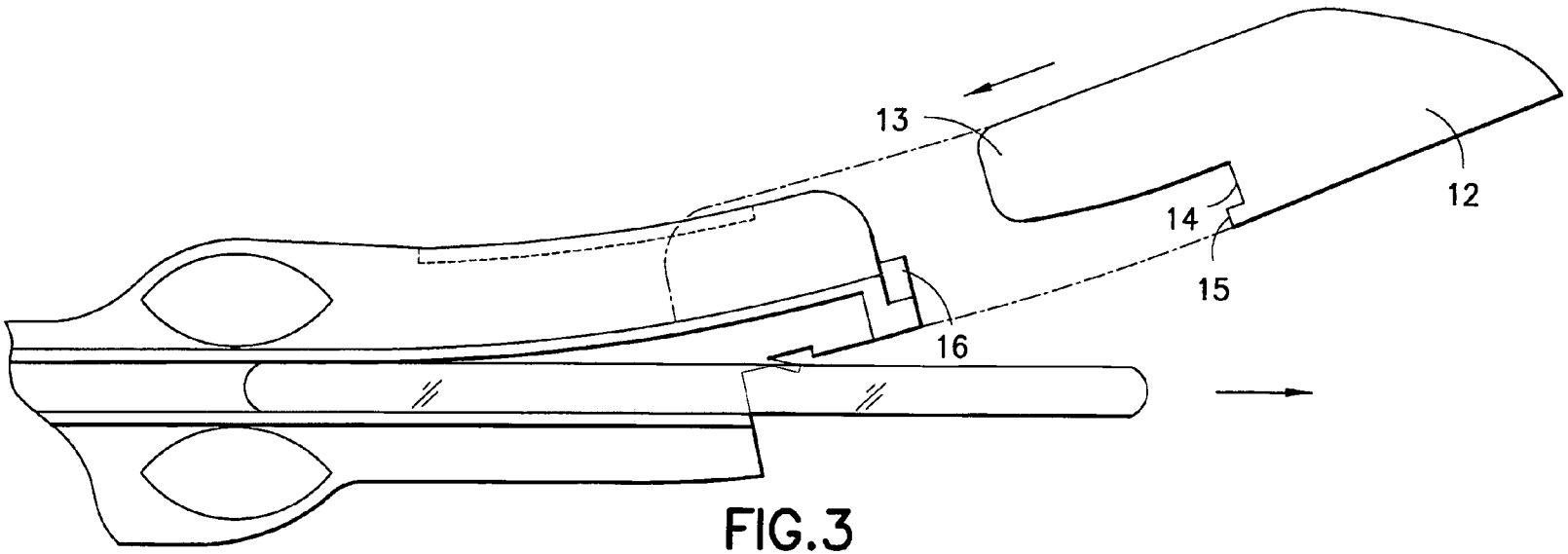
FIG. 3 is a view similar to FIG. 2 showing the use of the tool for removing the glass slat.

Furthermore, since the glass slat is held securely in the rigid plastic glass holder, in order to permit repair or maintenance on the slat the present invention further teaches a glass removal tool 12 as shown in FIG. 3. The tool 12 at one end has a tongue 13 with a side wall that extends from the end of the tool 12 to a bottom surface 14 that extends across a portion of the thickness of the tool 12 and ends in a lip 15 that extends away from the surface 14 in the same direction as the tongue 13, although to a much more limited extent. In this way, a notch is formed in the tool 12. For removing a slat, the side wall of the tongue 13 of the tool 12 is placed against an outer surface of one of the side walls of the glass slat 5 of the glass holder 4. The tool 12 is moved along the side wall of the slat until the notch formed by the lip 15 engages a projection 16 on the glass holder 4. The lip 15 snaps behind the projection 16 to temporarily lock the tool 12 in place. Next, for removing the glass from the glass holder, the tool is moved in the direction of arrow A in FIG. 3. This causes the wall of the glass holder to flex which allows the glass to be removed from the slat.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. A glass holder for a jalousie window, comprising:

a body having two parallel side walls which define a slot, and two webs which extend substantially perpendicularly in opposite directions from a base of the slot walls, the body having a length and the webs each extending from a respective end of the body over a respective portion of the length of the body, each web having an outer edge with a baffle that extends in a direction parallel to the slot walls, with the baffle of each web extending along less than half the length of the body and the remaining length of the body being without a baffle along each web.

2. The glass holder according to claim 1, wherein the body is made of rigid plastic.

3. A glass holder window as defined in claim 1, wherein the body is of a material having a strength sufficient to prevent deformation by finger pressure.

4. Jalousie window hardware comprising:

a longitudinally extending channel having a central wall and two side walls, the central wall having at least one opening therein; and a slat holder mounted in the opening of the channel so as to be rotatable therein, the slat holder having a body with two parallel side walls which define a slot, and two webs which extend substantially perpendicularly in opposite directions from a base of the slot walls, the body having a length and the webs each extending from a respective end of the body over a respective portion of the length of the body, each web having an outer edge with a baffle that extends in a direction parallel to the slot walls, with the baffle of each web extending along less than half the length of the body and the remaining length of the body being without a baffle along each web.

5. Jalousie window hardware according to claim 4, wherein the channel is made of aluminum and the slat holder is made of a rigid plastic.

6. A jalousie window, comprising:

a window frame having a top, a bottom and two sides extending between the top and the bottom;

a first channel member attached to one side of the window frame;

a second channel member attached to another side of the window frame, each of the channel members having a number of through holes therein arranged so that a through hole in one channel member is directly opposite a through hole in the other channel member;

a slat holder rotatably arranged in each of the through holes, the slat holder including a body having two parallel side walls which define a slot, and two webs which extend substantially perpendicularly in opposite directions from a base of the slot walls, the body having a length and the webs each extending from a respective end of the body over a respective portion of the length of the body, each web having an outer edge with a baffle that extends in a direction parallel to the slot walls, with the baffle of each web extending along less than half the length of the body and the remaining length of the body being without a baffle along each web; and a plurality of slats, each slat having a first end mounted in a slat holder on one side of the window frame and a second end mounted in a slat holder on the other side of the window frame.

7. A window as defined in claim 6, wherein the slat holders are made from a rigid plastic.

8. A window as defined in claim 6, further comprising an actuating mechanism provided in one of the channel members and operatively connected with the slat holders of the channel member so as to pivot the slat holders and the slats attached thereto between an open position and a closed position.

9. A window as defined in claim 8, wherein the baffles are arranged to extend laterally adjacent the side walls of the channel member in the closed position of the slat holders.

10. A window as defined in claim 6, wherein the slats are made of glass.

* * * * *